US007081074B1

(12) United States Patent
Rubin

(10) Patent No.: US 7,081,074 B1
(45) Date of Patent: Jul. 25, 2006

(54) EXERCISE DEVICE

(76) Inventor: Bruce Rubin, 120 Lucerne Blvd., Cherry Hill, NJ (US) 08003

( * ) Notice: Subject to any disclaimer, the term of this patent is extended or adjusted under 35 U.S.C. 154(b) by 0 days.

(21) Appl. No.: 11/053,768

(22) Filed: Feb. 9, 2005

(51) Int. Cl.
*A63B 22/16* (2006.01)

(52) U.S. Cl. ..... 482/146; 482/147; 482/34

(58) Field of Classification Search ..... 482/146–147, 482/34, 79, 80; D21/685–686, 665
See application file for complete search history.

(56) References Cited

U.S. PATENT DOCUMENTS

| | | | | |
|---|---|---|---|---|
| 1,585,748 | A * | 5/1926 | Wendelken | 482/143 |
| 3,784,193 | A | 1/1974 | Simjian | |
| 3,911,907 | A * | 10/1975 | Smith, Jr. | 482/1 |
| 4,305,579 | A | 12/1981 | Rice | |
| 4,456,245 | A | 6/1984 | Baldwin | |
| 4,629,181 | A * | 12/1986 | Krive | 482/71 |
| 4,673,180 | A | 6/1987 | Rice | |
| 5,352,176 | A | 10/1994 | Huang | |
| 5,632,711 | A * | 5/1997 | Hwang | 482/147 |
| 5,695,439 | A * | 12/1997 | Lin | 482/146 |
| 5,941,807 | A | 8/1999 | Cassidy et al. | |
| 6,244,994 | B1 | 6/2001 | Tilberis | |
| 6,875,159 | B1 * | 4/2005 | Chuang | 482/51 |

* cited by examiner

*Primary Examiner*—Lori Amerson
(74) *Attorney, Agent, or Firm*—Norman E. Lehrer

(57) ABSTRACT

An exercise device having a first base member with foot disks mounted thereon for rotating a person's lower body and a second base member including handles to be grasped by a person for rotating a person's upper body. The first and second base members are mounted so as to be capable of rotating about the same vertical axis. The first and second base members may be mechanically interconnected so as to be forced to rotate together but in opposite directions. Alternatively, the first and second base members may be disconnect from each other so that they can rotate independently. Either may also be fixed so as not to rotate. Similarly, the foot disks may rotate on the first base member independently of the first base member or can be fixed thereto so as to remain stationary in relation to the first base member. The second base member may be mounted overhead with the handles extending downwardly or it may be mounted adjacent the first base member and concentric therewith with the handles extending upwardly. In either embodiment, a variable resistance system can be incorporated to vary the difficulty of exercise.

6 Claims, 3 Drawing Sheets

EXERCISE DEVICE

BACKGROUND OF THE INVENTION

The present invention is directed toward an exercise device and more particularly, toward an exercise device that provides a full body workout using rotary motion.

Numerous types of exercise machines are available and are used by individuals in gyms, health clubs, fitness centers, rehabilitation centers, and the like, in order to exercise or rehabilitate different parts of the body. For example, elliptical machines, rowing machines, climbing machines, stationary bikes, and treadmills, to name a few, are some of the machines used. All of these machines, however, use linear motion. While these machines are effective, they do not utilize rotary core muscles or provide a means for improving a person's performance in playing sports that use rotary motion. Examples of such sports are tennis, golf, baseball, football, soccer, hockey, skiing, volleyball, etc.

Other machines are available that provide a rotary movement. For example, U.S. Pat. No. 4,305,579 to Rice discloses a rotating disk upon which a person stands. A plurality of handles may be grasped by the person exercising. However, the handles are fixed to floor and do not rotate independently of any support system. Thus, this device appears to be somewhat limited in its function and does not allow a person to exercise a wide enough variety of muscle groups.

Therefore, a need exists for an exercise machine that provides rotary motion in order to provide a full body workout.

SUMMARY OF THE INVENTION

The present invention is designed to overcome the deficiencies of the prior art discussed above. It is an object of the present invention to provide an exercise device that uses rotary motion in order to provide a full body workout.

It is another object of the present invention to provide an exercise device that provides rotary as well as linear motion in order to exercise various muscles groups of the body simultaneously with or independently of other muscle groups.

In accordance with the illustrative embodiments demonstrating features and advantages of the present invention, there is provided an exercise device having means for rotating a person's lower body and means for rotating a person's upper body. The means for rotating the upper body may be interconnected to the means for rotating the lower body so that the upper body and the lower body may be exercised simultaneously in similar or opposing directions. The means for rotating the person's lower body includes two foot disks and a first base member. The first base member, located adjacent the floor, is mounted for rotation about a vertical axis but could be fixed so as to remain stationary. The foot disks are mounted on the base member so as to be able to rotate on the first base member independently thereof. The foot disks may also remain stationary in relation to the first base member.

In a first embodiment of the invention, the means for rotating the person's upper body includes a second base member mounted overhead on a frame or ceiling for rotation about the same vertical axis as said first base member and includes downwardly extending handles that are adapted to be grasped by the person. The first and second base members may be interconnected through the use of a cable and a series of pulleys or other mechanical means so that they are forced to rotate in opposite directions. Alternatively, the interconnecting cable can be disconnected so that the first and second base members can rotate independently of each other.

In a second embodiment, the second base member is located adjacent the first base member and includes handles that extend upwardly to be grasped by the person exercising. As with the first embodiment, the handles and the second base member to which they are attached may rotate independently of the first base member or the two base members may be interconnected to rotate in unison but in opposite directions.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the drawings forms that are presently preferred; it being understood that the invention is not intended to be limited to the precise arrangements and instrumentalities shown.

DETAILED DESCRIPTION OF THE PREFERRED EMBODIMENTS

Figure 1:
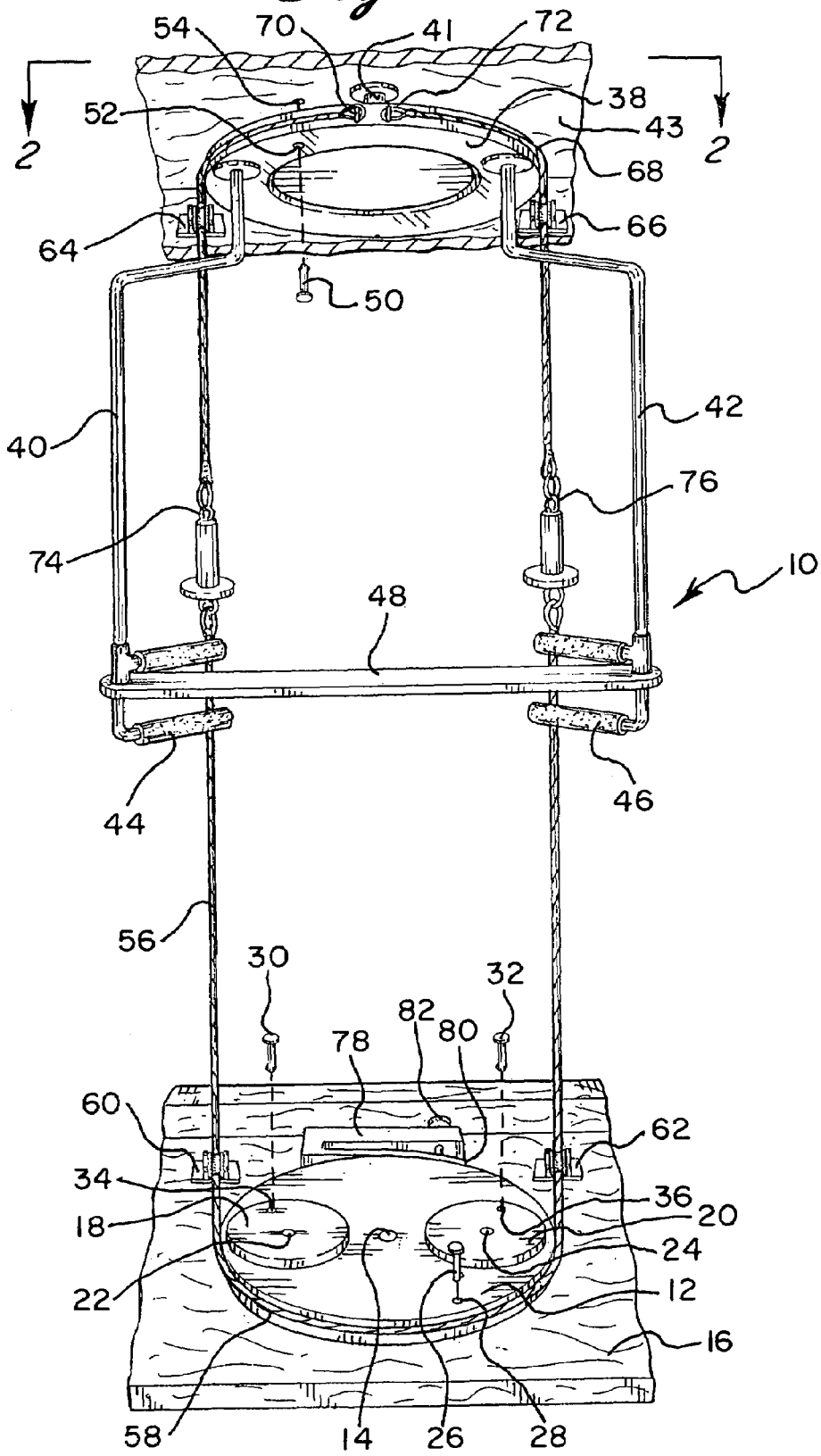
FIG. 1 is a front perspective view of a first embodiment of the exercise device of the present invention.
Figure 2:
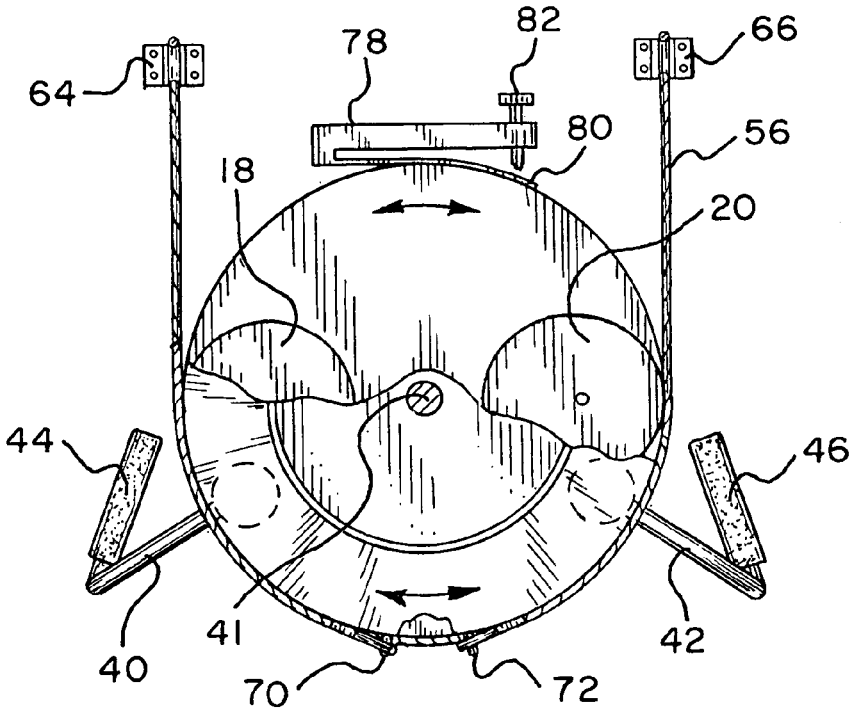
FIG. 2 is a cross-sectional view taken through line 2—2 of FIG. 1.
Figure 3:
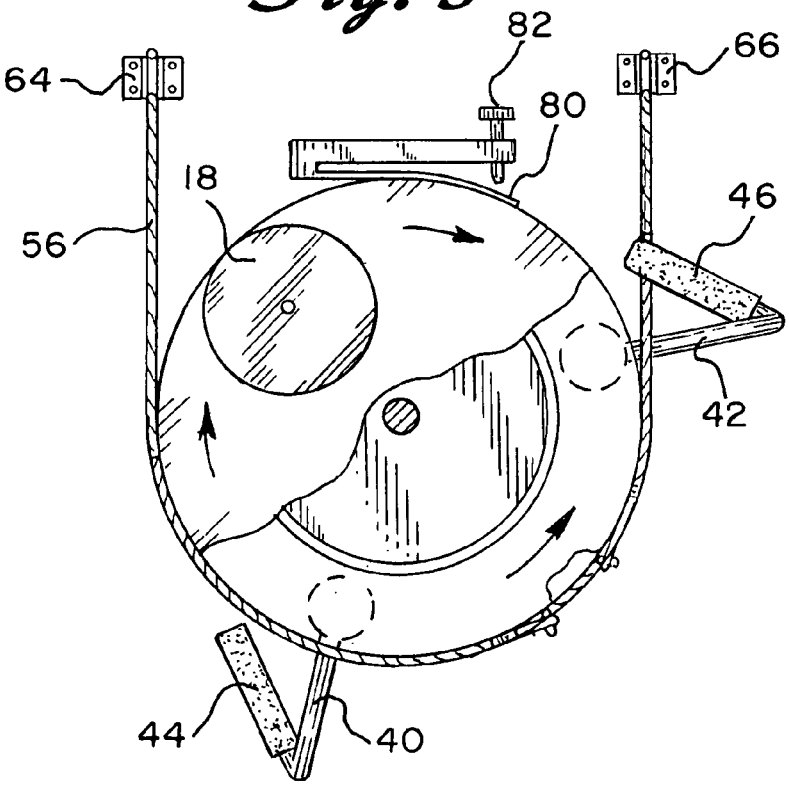
FIG. 3 illustrates the movement of the handles of the exercise device of the present invention.

Referring now to the drawings in detail wherein like reference numerals have been used throughout the various figures to designate like elements, there is shown in FIG. 1 an exercise device constructed in accordance with the principles of the present invention and designated generally as 10.

The exercise device of the present invention essentially includes means for rotating a person's lower body and means for rotating a person's upper body. The means for rotating the upper body may be linked to the means for rotating the lower body so that the upper body and the lower body may be exercised simultaneously but in opposite directions. Alternatively, the means for rotating the upper body and the means for rotating the lower body may operate independently of each other.

More specifically, the means for rotating the person's lower body includes a substantially disk shaped first base member 12 that is mounted for rotation about vertical axis 14 with respect to the floor or other horizontal support 16. Foot disks 18 and 20 are mounted on the first base member 12 so as to rotate relative thereto about substantially vertical axis 22 and 24, respectively. In use, a person wishing to exercise stands on the foot disks 18 and 20 and can rotate his or her body in a clockwise or counterclockwise direction relative to the floor while allowing his or her feet to pivot as a result of the rotation of the foot disks 18 and 20.

While the first base member 12 and the foot disks 18 and 20 are mounted so as to be rotatable, there may be times during certain exercises that it is desirable to prevent their rotation. Means are therefore provided to prevent rotation of any one or all of these elements. Such means can be simply a pin such as shown at 26 that can be inserted into an aperture 28 formed in the base member 12 and which then enters a similar aperture (not shown) formed in the support 16. Similarly pins 30 and 32 and apertures 34 and 36 (with corresponding apertures formed in the first base member) can be used, when desired to prevent rotation of the foot disks 18 and 20 relative to the first base member 12. As a result, the person exercising can choose whether to allow either the first base member 12 or either of the foot disks 18 and 20 to rotate or to be fixed against rotation independently of the other elements. The pins and apertures are, of course, only one example of a means for preventing rotation. Numerous alternative methods will be readily apparent to those skilled in the art.

The means for rotating the person's upper body includes an overhead second or upper base member 38 mounted for rotation about vertical axis 41 to the ceiling or an upper frame 43. The upper base member 38 is preferably disk shaped although other shapes are possible. Preferably, the axis 41 is in substantial axial alignment with the axis 14 of the first base member 12. Extending downwardly from the upper base member 38 are spaced apart handle means 40 and 42. The handle means 40 and 42 terminate in handle grips 44 and 46, respectively, that are adapted to be gripped by the person exercising. As shown, the handle grips 44 and 46 substantially overlie the foot disks 18 and 20. A horizontal tie bar 48 secures the lower ends of the handle means 40 and 42 together. Tie bar 48 could also be used to support additional handles in order to offer different hand positions to the person exercising.

Although the upper second base member 38 is mounted for rotation, means are provided for preventing rotation thereof which may be desirable for certain exercises. As with the first base member 12, the second base member may have a pin 50 that passes through an aperture 52 and into another aperture 54 in the upper frame 43. Obviously, since the pin 50 is being inserted overhead, some type of holding means must be provided for preventing the pin 50 from falling out as a result of gravity.

For many exercises, it is desirable to force the first base member 12 and the upper base member 38 to move in unison. This is accomplished by the use of a cable 56 that passes around a groove 58 at the periphery of the first base member 12, around floor mounted pulleys 60 and 62 and overhead mounted pulleys 64 and 66 and into the groove 68 at the periphery of the second base member 38 where it terminates at points 70 and 72. With the cable in place as just described, clockwise rotation of the lower base member 12 forces counterclockwise rotation of the second frame member 38 and vice versa. If it is desired to operate the first and second base members independently of each other, it is only necessary to disconnect the cable 56 at point 74 or 76 utilizing any known cable connector. The free cable ends can then be moved out of the way.

The exercise device 10 may also be provided with a means for retarding movement of one or both of the base members in order to increase the force needed by the person exercising to rotate the base members. As an example, a brake 78 may be provided at the floor 16 adjacent the periphery of the first base member 12. The brake 78 includes a brake shoe 80 that is adapted to press against the side edge of the base member. A hand screw 82 can be turned by the person exercising to increase to force of the brake shoe 80 against the base member 12 in order to increase or decrease the amount of resistance to motion.

Figure 4:
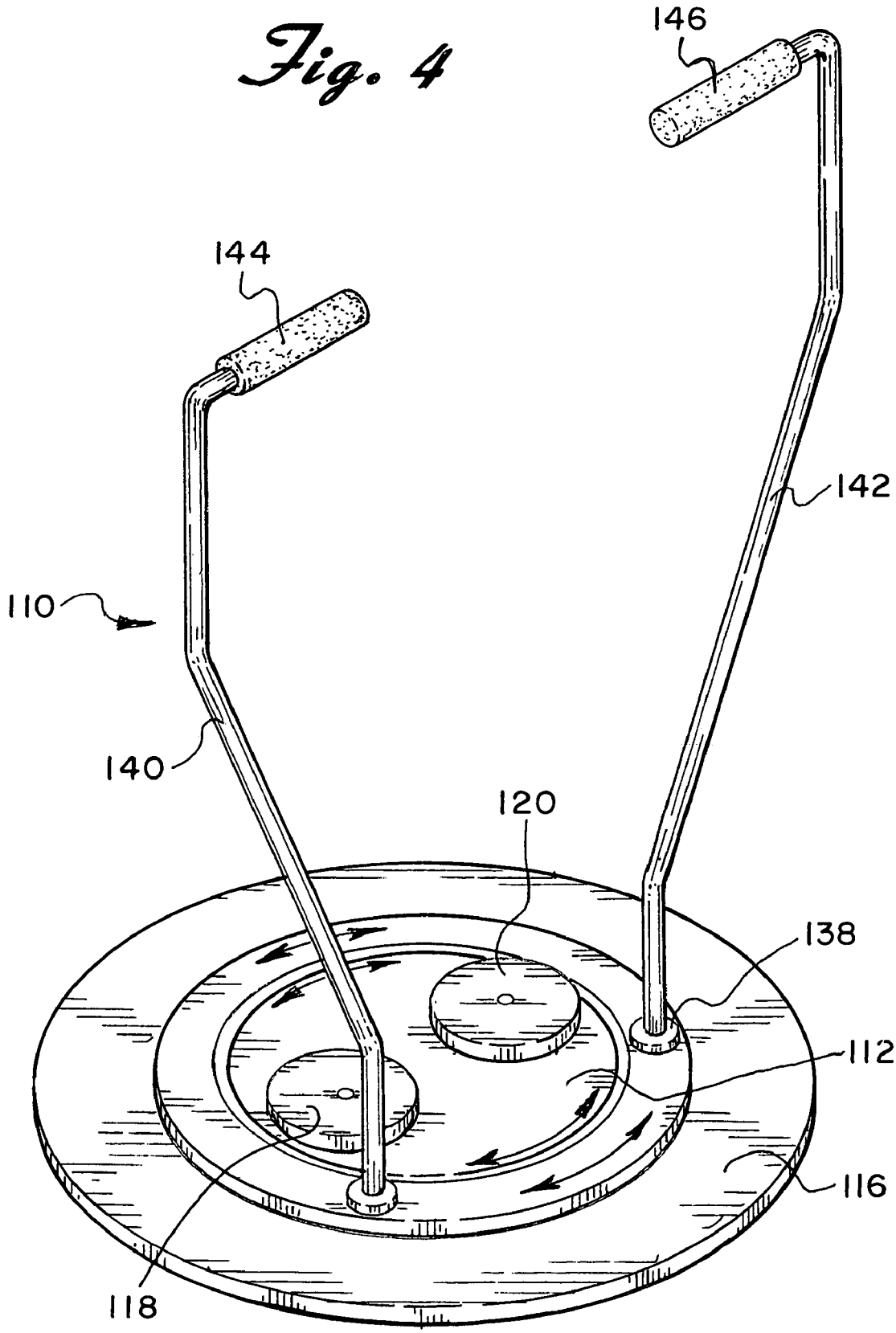
FIG. 4 is a second embodiment of the exercise device of the present invention.

A second embodiment of the invention is shown in FIG. 4. The exercise device 110 functions in substantially the same manner as the first embodiment. In this embodiment, however, the second base member 138 is also rotatably mounted at the floor 116 and is concentric with the first base member 112. In lieu of a cable, gears or the like may be used to force the first and second base members to rotate together but in opposite directions. Disconnecting the gears would then allow the first and second base members to rotate independently of each other.

As with the first embodiment, handle means 140 and 142 with hand grips 144 and 146 are connected to the second base member 138. However, in this second embodiment, the handle means extend upwardly so as to be gripped by the person exercising. In substantially all other respects, the first and second embodiments of the invention operate in the substantially the same manner. That is first base member 112 may be rotated independently of the second base member 138 or in unison therewith. In addition, any of the base members and foot disks can be fixed against rotation if that is desired.

The present invention may be embodied in other specific forms without departing from the spirit or essential attributes thereof and accordingly, reference should be made to the appended claims rather than to the foregoing specification as indicating the scope of the invention.

I claim:

1. An exercise device comprising:

a first base member upon which a person exercising may stand, said first base member being capable of rotating about a first vertical axis, a second base member rotatable independently of said first base member about a second vertical axis which is in axial alignment with said first vertical axis, and handles fixed to and extending upwardly from said second base member and being grasped by a person while standing on said first base member, said handles moveable with said second base member.

2. The exercise device of claim 1 further including first and second foot disks, said disks being mounted on said first base member so as to be capable of rotating relative to said first base member.

3. The exercise device of claim 2 further including means for preventing said foot disks from rotating relative to said first base member.

4. The exercise device of claim 1 further including means for preventing said first base member from rotating.

5. The exercise device of claim 1 further including means for preventing said second base member from rotating.

6. The exercise device of claim 1 wherein said second base member is mounted adjacent said first base member and concentric therewith and wherein said handles extend upwardly so as to be grasped by said person.

* * * * *